US007738804B2

(12) United States Patent
Yoda

(10) Patent No.: US 7,738,804 B2
(45) Date of Patent: Jun. 15, 2010

(54) IMAGE FORMING APPARATUS

(75) Inventor: Junya Yoda, Osaka (JP)

(73) Assignee: Kyocera Mita Corporation (JP)

( * ) Notice: Subject to any disclaimer, the term of this patent is extended or adjusted under 35 U.S.C. 154(b) by 504 days.

(21) Appl. No.: 11/888,968

(22) Filed: Aug. 3, 2007

(65) Prior Publication Data

US 2008/0253787 A1 Oct. 16, 2008

(30) Foreign Application Priority Data

Aug. 4, 2006 (JP) ..... 2006-213812
Aug. 10, 2006 (JP) ..... 2006-218684

(51) Int. Cl.
*G03G 15/20* (2006.01)
*G03G 15/00* (2006.01)

(52) U.S. Cl. ..... 399/67; 399/88

(58) Field of Classification Search ..... 399/67, 399/69, 88–90

See application file for complete search history.

(56) References Cited

U.S. PATENT DOCUMENTS 6,987,936 B2 * 1/2006 Satoh et al. ..... 399/88
2002/0061199 A1 * 5/2002 Horobin et al. ..... 399/69
2006/0133846 A1 * 6/2006 Okamoto ..... 399/88

FOREIGN PATENT DOCUMENTS

JP 2003-297526 10/2003

* cited by examiner

*Primary Examiner*—David M Gray
*Assistant Examiner*—Joseph S Wong
(74) *Attorney, Agent, or Firm*—Gerald E. Hespos; Michael J. Porco

(57) ABSTRACT

A controller is operative to heat a first fixing heater by an electric power from a commercial power source, and to heat a second fixing heater by an electric power from an electric storage device in a state that driving of a voltage boosting device is suspended by a PWM controller and an MOS transistor in an initial stage of driving a fixing heater unit. The controller is also operative to drive the second fixing heater by an electric power from the electric storage device which is boosted by the voltage boosting device by driving the voltage boosting device by the PWM controller and the MOS transistor after an inrush current to the second fixing heater has dropped to a certain level.

12 Claims, 14 Drawing Sheets

TURN ON HEATER
HEATER DRIVE SIGNAL

500msec
TURN ON CONVERTER
VOLTAGE BOOSTING DEVICE DRIVE SIGNAL

PEAK CURRENT 200A
RATED CURRENT 26A
OUTPUT CURRENT
26A
0A
100msec
ACTIVATE VOLTAGE BOOSTING DEVICE

75V
OUTPUT VOLTAGE
40V
0V

IMAGE FORMING APPARATUS

BACKGROUND OF THE INVENTION

1. Field of the Invention

The present invention relates to an image forming apparatus, and more particularly to a technology of controlling an electric power supply to a fixing device for fixing a toner on a recording sheet by applying a heat.

2. Description of the Background Art

There is known an image forming apparatus such as a copier, wherein a fixing roller is heated by applying a large electric current to a fixing heater with use of a commercial power source and an auxiliary power source device e.g. an electric dual-layer capacitor to reduce a time required for the fixing roller to reach a predetermined fixing temperature when the apparatus is in an initial startup condition or in an energy saving mode where the apparatus is in a standby state for a printing operation, with its power supply to the fixing heater being suspended. In the image forming apparatus, the voltage of the electric dual-layer capacitor itself to be used as the auxiliary power source device is relatively low e.g. 2.5V. In view of this, e.g. Japanese Unexamined Patent Publication No. 2003-297526 proposes use of a voltage boosting circuit. Specifically, in the publication, an electric power of the electric dual-layer capacitor is supplied to the fixing heater, after the voltage of the electric dual-layer capacitor is boosted to a voltage suitable for supplying to the fixing heater by the voltage boosting circuit.

Generally, a halogen heater to be used as the fixing heater has a low resistance in a normal temperature condition before being heated. When a voltage is applied to the halogen heater at the start time of heating the heater, an inrush current of a value several times or several ten times as high as that of a rated current flows to the heater. As a result, a coil in the voltage boosting circuit is saturated by the inrush current, which hinders the voltage boosting circuit from functioning properly. In view of this, the electric dual-layer capacitor and the voltage boosting circuit are controlled not to supply their electric powers to the heater at the start time of heating the fixing roller when an inrush current flows. If the aforementioned control of avoiding an inrush current is performed by causing the electric dual-layer capacitor and the voltage boosting circuit to wait for their electric power supply operations until the inrush current disappears, a startup time required for the fixing heater to perform an intended heating operation may be extended, which may resultantly increase a time required for the fixing roller to reach the predetermined fixing temperature. Also, there is proposed an idea of providing an inrush current preventing circuit between the voltage boosting circuit and the fixing heater to prevent an inrush current from flowing to the fixing heater so as to drive the voltage boosting circuit while suppressing flow of the inrush current. In this arrangement, the inrush current preventing circuit is an indispensable element.

SUMMARY OF THE INVENTION

In view of the above problems residing in the prior art, it is an object of the invention to provide an image forming apparatus that enables to supply an electric power from an auxiliary power source device to a second fixing heater, with a less costly arrangement, while suppressing an adverse effect of an inrush current to a voltage boosting circuit even in an inrush current flow period, and to reduce a time required for a fixing roller to reach a predetermined fixing temperature.

An image forming apparatus according to an aspect of the invention includes: an auxiliary power source device having a capacitor; a fixing heater unit including a first fixing heater driven by an electric power from an external power source, and a second fixing heater provided with a halogen heater and driven by an electric power from the auxiliary power source device, the fixing heater unit being adapted to apply a heat to a fixing device of the image forming apparatus for fixing a toner on a sheet; a voltage boosting circuit including an insulating converter configured in such a manner that a primary end of the voltage boosting circuit is connected to the auxiliary power source device, an end of a secondary end thereof is connected to the second fixing heater, and the other end of the secondary end is connected to the auxiliary power source device, the voltage boosting circuit being adapted to boost an output voltage from the auxiliary power source device to output the boosted voltage to the second fixing heater; and a controller for controlling the electric power supply to the fixing heater unit, wherein the second fixing heater has an end thereof connected to the secondary end of the voltage boosting circuit, and the other end thereof connected to the auxiliary power source device, and the controller is operative to drive the first fixing heater by the electric power from the external power source, and drive the second fixing heater by the electric power from the auxiliary power source device without superimposing an output from the voltage boosting circuit in an initial stage of driving the fixing heater unit; and supply a superimposed output to the second fixing heater upon lapse of a predetermined duration after an inrush current flows to the second fixing heater, the superimposed output being obtained by superimposing the output from the voltage boosting circuit over an output from the auxiliary power source device.

In the above arrangement, the controller is operative to drive the first fixing heater by the output from the external power source, and drive the second fixing heater by the output from the auxiliary power source device without superimposing the output from the voltage boosting circuit in the initial stage of driving the fixing heater unit. Thereby, the electric power from the auxiliary power source device can be supplied to the second fixing heater without causing an adverse effect resulting from the inrush current to the voltage boosting circuit even in an inrush current flow period. This enables to reduce a time required for a fixing roller to reach a predetermined fixing temperature.

These and other objects, features and advantages of the present invention will become more apparent upon reading the following detailed description along with the accompanying drawing.

DETAILED DESCRIPTION OF THE PREFERRED EMBODIMENTS

Figure 1:
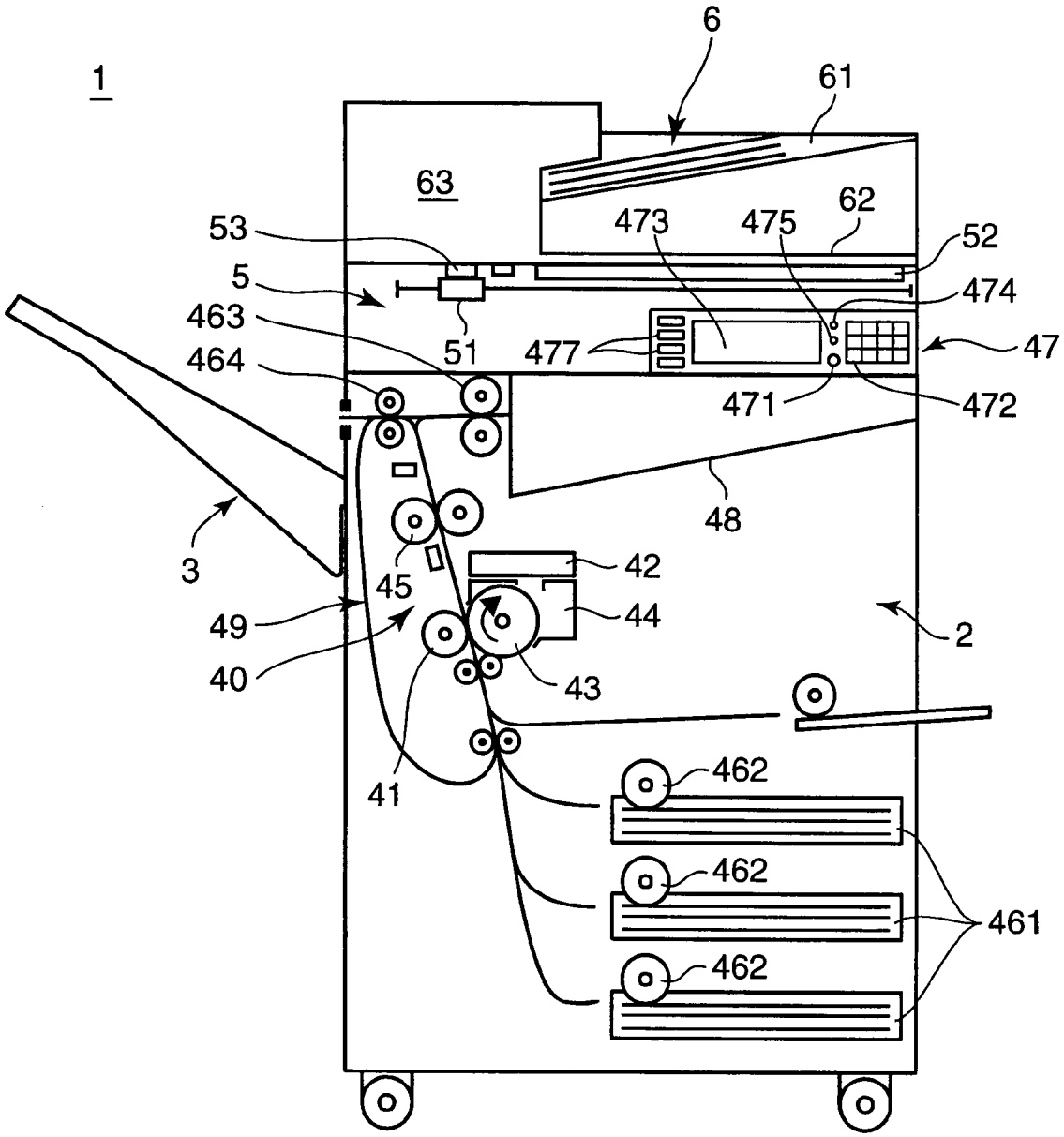
FIG. 1 is a side view schematically showing an internal arrangement of a complex machine, as an example of an image forming apparatus embodying the invention.

In the following, an embodiment of the invention is described referring to the drawings. FIG. 1 is a side view schematically showing an internal arrangement of a complex machine, as an example of an image forming apparatus embodying the invention. The complex machine 1 has multiple functions such as a copying function, a printing function, a scanning function, and a facsimile function. The complex machine 1 includes a main body 2, a stacker tray 3 disposed on the right of the machine main body 2, a document reader 5 disposed on a top part of the machine main body 2, and a document feeder 6 disposed above the document reader 5.

An operation section 47 is provided on a front part of the complex machine 1. The operation section 47 includes: a start key 471 for allowing a user to input a print execution command; a ten key 472 for allowing the user to input the number of prints or the like; a display section 473 which is adapted to display operation guide information or the like concerning various copying operations, and is provided with a liquid crystal display or a like device having a touch-panel function for allowing the user to input various settings concerning the operation guide information; a reset key 474 for resetting the setting contents set on the display section 473; a stop key 475 for suspending an ongoing printing operation i.e. image forming operation; and a function changeover key 477 for changing over the function of the complex machine 1 among the copying function, the printing function, the scanning function, and the facsimile function.

The document reader 5 has a scanner unit 51 equipped with a CCD (Charge Coupled Device) sensor and an exposure lamp, a document table 52 made of a transparent member such as a glass member, and a document reading slit 53. The scanner unit 51 is movable by an unillustrated driver. Specifically, in reading a document placed on the document table 52, the scanner unit 51 is moved to such a position as to oppose the document table 52 along a document plane, acquires image data while scanning the document image, and outputs the acquired image data to a controller 10 (see FIG. 2). In reading a document fed by the document feeder 6, the scanner unit 51 is moved to such a position as to oppose the document reading slit 53, acquires the document image in synchronism with a transport operation of the document by the document feeder 6 through the document reading slit 53, and outputs the acquired image data to the controller 10.

The document feeder 6 includes a document setter 61 for placing a document or documents, a document discharger 62 for discharging the document(s) after the image reading, and a document transport mechanism 63, provided with a feed roller (not shown) and a transport roller (not shown), for successively transporting the documents placed on the document setter 61 to a position as opposed to the document reading slit 53 so as to discharge the documents to the document discharger 62. The document transport mechanism 63 has a document inverting mechanism (not shown) for inverting the document to transport the document to the position as opposed to the document reading slit 53 again, whereby both-side images of the document are read by the scanner unit 51 through the document reading slit 53.

The document feeder 6 is pivotally mounted to the machine main body 2 in such a manner that a front part of the document feeder 6 is pivotally moved upward. By pivotally moving the front part of the document feeder 6 upward to open an upper surface of the document table 52, the user is allowed to place a document e.g. a book in an opened state on the upper surface of the document table 52.

The machine main body 2 includes a number of sheet cassettes 461, a sheet feed roller 462 for dispensing recording sheets (hereinafter, simply called as "sheet" or "sheets") accommodated in the corresponding sheet cassette 461 one by one to transport the sheet to a recording section 40, and the recording section 40 for forming an image on the sheet transported from the sheet cassette 461.

The recording section 40 includes an optical unit 42 for outputting a laser beam or the like to expose a photosensitive drum 43 with the laser beam, based on the image data acquired in the scanner unit 51, a developer 44 for forming a toner image on the surface of the photosensitive drum 43, a transferer 41 for transferring the toner image formed on the photosensitive drum 43 to the sheet, a fixing device 7 for fixing the toner image on the sheet by applying a heat to the sheet carrying the toner image, and transport roller pairs 463, 464, provided at respective appropriate positions on a sheet transport path in the recording section 40, to transport the sheet to the stacker tray 3 or a discharge tray 48.

In the case where an image is formed on both sides of a sheet, after an image is formed on one side of the sheet in the recording section 40, the sheet is nipped by the transport roller pair 463 near the discharge tray 48. Then, the sheet in the nipped state is switchbacked by reversing the rotating direction of the transport roller pair 463. After the switchback, the sheet is transported upstream of the recording section 40 again along a sheet transport path 49 for image formation on the other side of the sheet in the recording section 40. Thereafter, the sheet is discharged onto the stacker tray 3 or the discharge tray 48.

Figure 2:
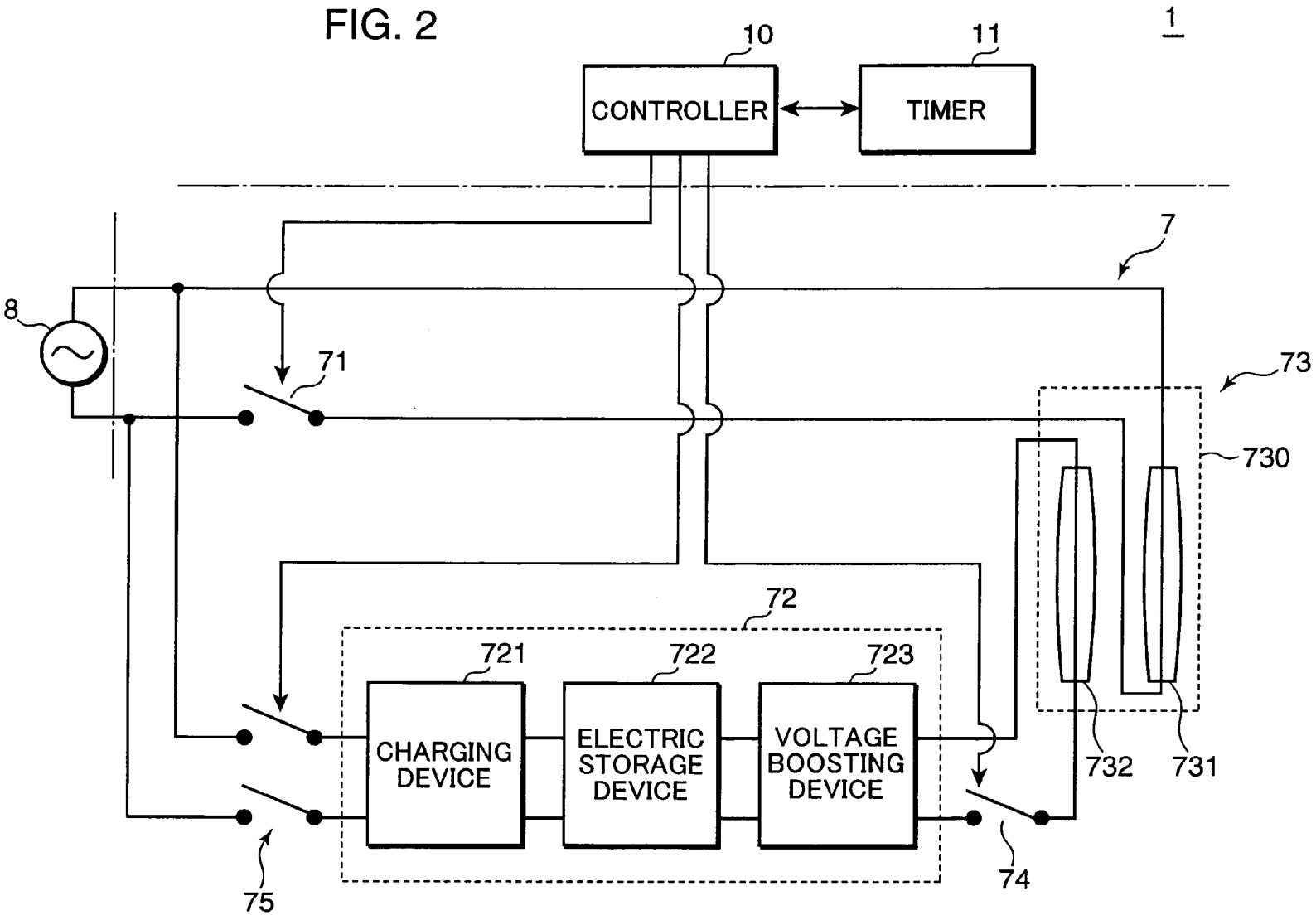
FIG. 2 is a diagram showing an internal arrangement of a fixing device and its peripheral parts provided in the complex machine.

FIG. 2 is a diagram showing an internal arrangement of a fixing device 7 and its peripheral parts provided in the complex machine 1. The fixing device 7 includes a first power source switch 71, an auxiliary power source unit 72, a fixing roller unit 73, an auxiliary power source switch 74, and a charging switch 75.

The fixing roller unit 73 has a pressure roller for applying a pressure to a sheet, and a heat roller for applying a heat to the sheet. The fixing roller unit 73 is operated in such a manner that the sheet has its toner image formed thereon fixed while being pressingly contacted between the pressure roller and the heat roller. A fixing heater 730 is provided in the heat roller of the fixing roller unit 73 to apply a heat to the sheet. FIG. 2 primarily shows the fixing heater 730 in the fixing roller unit 73. The fixing heater 730 has a first fixing heater 731 and a second fixing heater 732. In this embodiment, the first fixing heater 731 is a halogen heater which is heated by an electric power supplied from a commercial AC power source 8 i.e. an external power source, and the second fixing heater 732 is a halogen heater which is heated by an electric power supplied from the auxiliary power source unit 72.

The first power source switch 71 is provided between the commercial power source 8 and the first fixing heater 731, and is an on-off switch for switching over whether an electric power of AC 100V is to be supplied from the commercial power source 8 to the first fixing heater 731, in other words, whether the first fixing heater 731 is driven i.e. heated. The first power source switch 71 is turned on or off to supply or suspend the supply of the electric power of AC 100V from the commercial power source 8, based on an on-off signal to be inputted from the controller 10 which controls overall operations of the complex machine 1.

The auxiliary power source switch 74 is provided between the auxiliary power source unit 72 and the second fixing heater 732, and is an on-off switch for switching over whether an electric power from the auxiliary power source unit 72 is to be supplied to the second fixing heater 732, in other words, whether the second fixing heater 732 is driven i.e. heated. The auxiliary power source switch 74 is turned on or off to supply or suspend the supply of the electric power from the auxiliary power source unit 72, based on an on-off signal to be inputted from the controller 10.

The charging switch 75 is provided between the commercial power source 8 and the auxiliary power source unit 72, and is an on-off switch for switching over whether an electric power from the commercial power source 8 is to be supplied to the auxiliary power source unit 72. Similarly to the first power source switch 71, the charging switch 75 is turned on or off to supply or suspend the supply of the electric power from the commercial power source 8, based on an on-off signal to be inputted from the controller 10. The controller 10 turns on the charging switch 75 to cause a charging device 721 and an electric storage device 722 to perform a charging operation in the case where the electric power use amount of the commercial power source 8 with respect to the complex machine 1 is small, because the complex machine 1 is in a sleep mode i.e. a print standby state, or the main power source switch of the complex machine 1 is turned off, or a like condition.

The auxiliary power source unit 72 is provided as an auxiliary power source device for the commercial power source 8 to supply an electric power to the second fixing heater 732. The auxiliary power source unit 72 includes the charging device 721, the electric storage device 722, and a voltage boosting device 723.

The charging device 721 is an AC/DC converter for charging the electric storage device 722, and outputs, to the electric storage device 722, a rectified current of an alternate current voltage e.g. AC 100V from the commercial power source 8.

The electric storage device 722, as an example of an auxiliary power source device of the claimed invention, includes a single electric dual-layer capacitor, or plural electric dual-layer capacitors connected in series. The electric storage device 722 is operated in such a manner that the electric dual-layer capacitor is charged with an electric current from the charging device 721 as an electric charge, and that the electric charge accumulated in the electric dual-layer capacitor is discharged and outputted to the voltage boosting device 723 as a discharging current.

The voltage boosting device 723, as an example of a voltage boosting circuit of the claimed invention, is adapted to boost a voltage to be outputted from the electric storage device 722 as an input voltage to a predetermined voltage suitable for the second fixing heater 732 as a load so that the electric power after the voltage boosting operation is supplied to the second fixing heater 732. The voltage boosting device 723 is an insulating DC/DC converter whose input end and output end are insulated by an insulating transformer.

The controller 10 controls the overall operations of the complex machine 1. The controller 10 controls on-off operations of the first power source switch 71, the auxiliary power source switch 74, and the charging switch 75.

Also, the controller 10 is connected to a timer 11. The timer 11 measures a lapse of a predetermined duration. The predetermined duration is an estimated time required for an inrush current (to be described later) generated at the start time of heating the second fixing heater 732 to drop to such a low level that does not adversely affect an operation of the complex machine 1, e.g. an estimated time required for a rated current to flow to the second fixing heater 732. The predetermined duration is empirically and properly set by a manufacturer or an equivalent party, depending on the performance of the second fixing heater 732.

The controller 10 drives the voltage boosting device 723 upon lapse of the predetermined duration measured by the timer 11 to switch over the output to be supplied to the second fixing heater 732 to a superimposed output obtained by superimposing the output from the voltage boosting device 723 over the output from the electric charge device 722.

Figure 3:
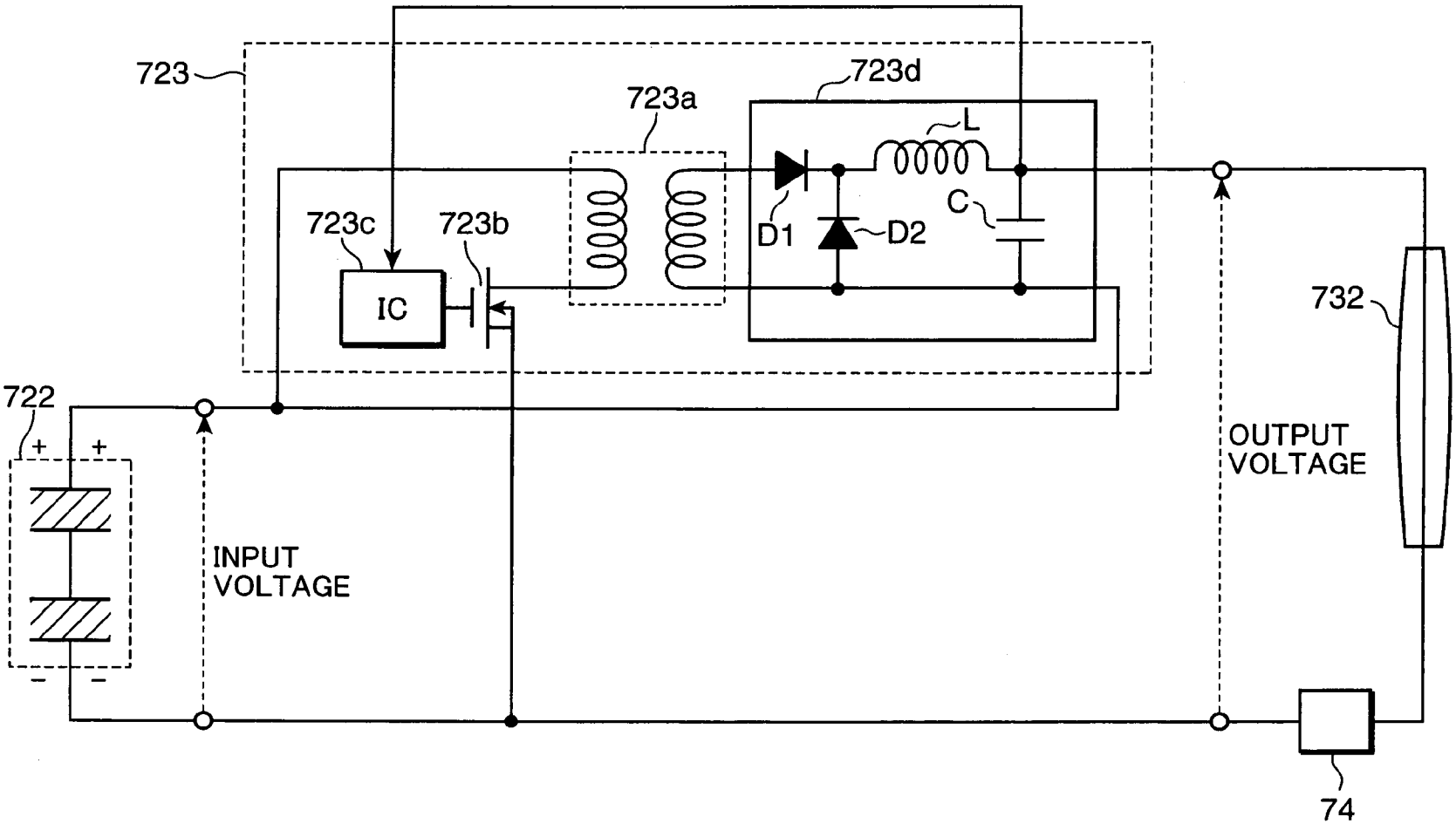
FIG. 3 is a circuit diagram showing a schematic arrangement of a voltage boosting device, as well as a connecting relation between the voltage boosting circuit, and an electric storage device and a second fixing heater in a first embodiment of the invention.

In the following, an arrangement of the voltage boosting device 723 as a first embodiment of the invention is described. FIG. 3 is a circuit diagram showing a schematic arrangement of the voltage boosting device 723, as well as a connecting relation between the electric storage device 722 and the second fixing heater 732 in the first embodiment.

As shown in FIG. 3, the voltage boosting device 723 of the first embodiment includes a transformer 723*a*, an MOS transistor 723*b*, a PWM controller 723*c*, and a smoothing circuit 723*d*.

The transformer 723*a*, as an insulating converter of the claimed invention, is an insulating transformer, and is constituted of a primary winding and a secondary winding with a winding ratio suitable for generating an intended voltage in the second fixing heater 732. One end of the primary winding of the transformer 723*a* is connected to one end i.e. a positive voltage end of the electric storage device 722, and the other end of the primary winding is connected to the drain terminal of the MOS transistor 723*b*. Both ends of the secondary winding of the transformer 723*a* are connected to the smoothing circuit 723*d*.

The MOS transistor 723*b* is adapted to switch over a discharging current to be inputted from the electric storage device 722. As described above, the MOS transistor 723*b* is constructed in such a manner that the drain terminal thereof is connected to the other end of the primary winding of the transformer 723*a*, the source terminal thereof is connected to the other end i.e. a negative voltage end of the electric storage device 722, and the gate terminal thereof is connected to the PWM controller 723*c*. With this construction, the primary end of the transformer 723*a* is connected to the electric storage device 722 so that the electric power from the electric storage device 722 is outputted to the transformer 723*a*.

The PWM controller 723*c* causes the MOS transistor 723*b* to switch over to supply the electric power from the electric storage device 722 to the voltage boosting device 723 upon receiving an on signal for driving the voltage boosting device 723 from the controller 10. Also, the PWM controller 723*c* causes the MOS transistor 723*b* to switch over to suspend the electric power supply from the electric storage device 722 to the voltage boosting circuit 723 upon receiving an off signal for suspending the driving of the voltage boosting device 723 from the controller 10.

Also, the PWM controller 723*c* generates a PWM signal for setting a voltage to be outputted from the smoothing circuit 723*d* as an auxiliary power source voltage to a predetermined constant value, and causes the MOS transistor 723*b* to switch over to supply the PWM signal to the gate terminal of the MOS transistor 723*b*. With this arrangement, even if the charged voltage of the electric dual-layer capacitor of the electric storage device 722 is gradually decreased by a discharging operation, and the input voltage of the voltage boosting device 723 is lowered accordingly, the drive voltage of the second fixing heater 732 is retained to a constant value, thereby stabilizing heat generation of the second fixing heater 732. The PWM controller 723*c* and the MOS transistor 723*b* correspond to an example of a drive changer of the claimed invention.

The smoothing circuit 723*d* includes diodes D1, D2, a coil L, and a capacitor C, which are connected as illustrated in FIG. 3. The smoothing circuit 723*d* smoothes a secondary winding voltage supplied from the secondary winding of the transformer 723*a*, and outputs the smoothed voltage, as an auxiliary power source voltage. Similarly to the one end of the primary winding of the transformer 723*a*, one output end of the smoothing circuit 723*d* is connected to the one end i.e. the positive voltage end of the electric storage device 722. A device having an impulse withstand voltage is used as the diode D2 to prevent breakage of the fixing heater unit by an inrush current generated in an initial stage of driving the second fixing heater 732. The other output end of the smoothing circuit 723*d*, and the negative voltage end of the electric storage device 722 are connected to the second fixing heater 732.

Specifically, the auxiliary power source unit 72 has the voltage boosting device 723, whose input end corresponding to a primary end and whose output end corresponding to a secondary end are insulated by the transformer 723*a*. The auxiliary power source unit 72 is constructed in such a manner that the primary end of the voltage boosting device 723 is connected to the electric storage device 722, one end of the secondary end of the voltage boosting device 723 is connected to the electric storage device 722, and the other end of the secondary end of the voltage boosting device 723 is connected to the second fixing heater 732. With this arrangement, the auxiliary power source voltage at the output end of the auxiliary power source unit 72 is a sum voltage i.e. a superimposed voltage in which the output voltage from the voltage boosting device 723 is superimposed over the charged voltage of the electric storage device 722.

Figure 4:
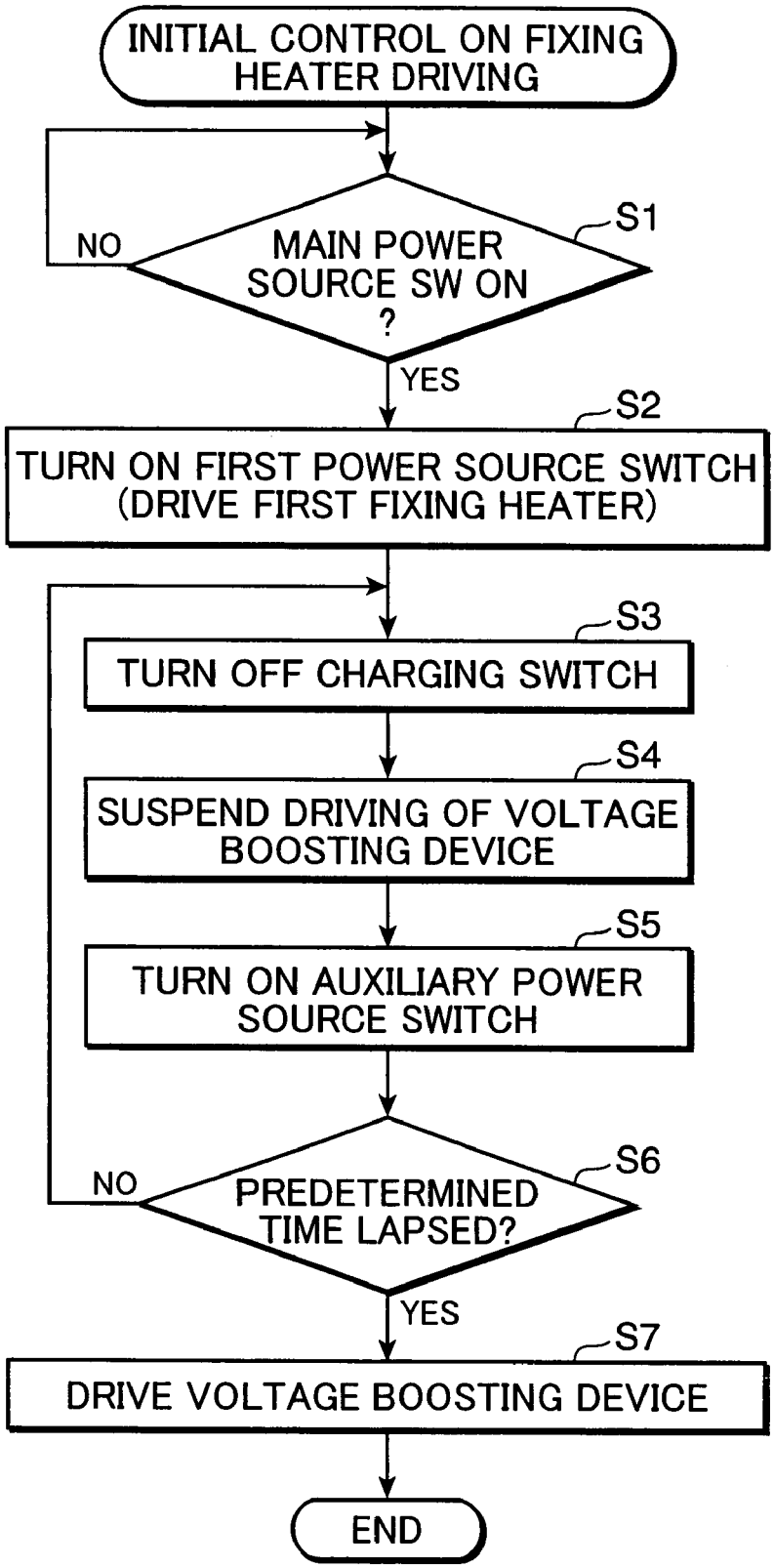
FIG. 4 is a flowchart showing a control to be executed at a startup time of the fixing device provided with the voltage boosting device in the first embodiment.
Figure 5:
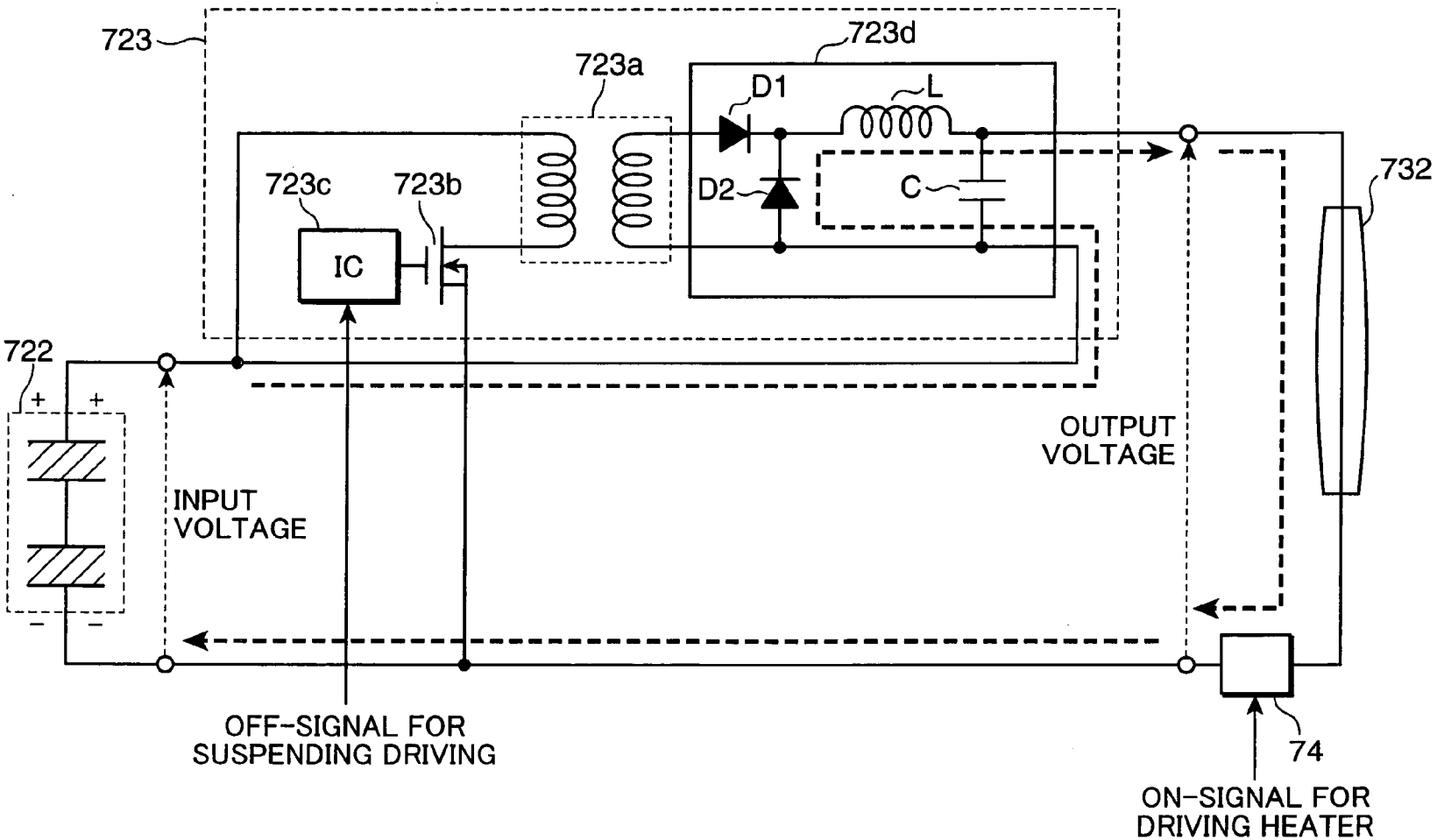
FIG. 5 is a circuit diagram showing a current path in an initial stage of a startup operation of the fixing device provided with the voltage boosting device in the first embodiment.
Figure 6:
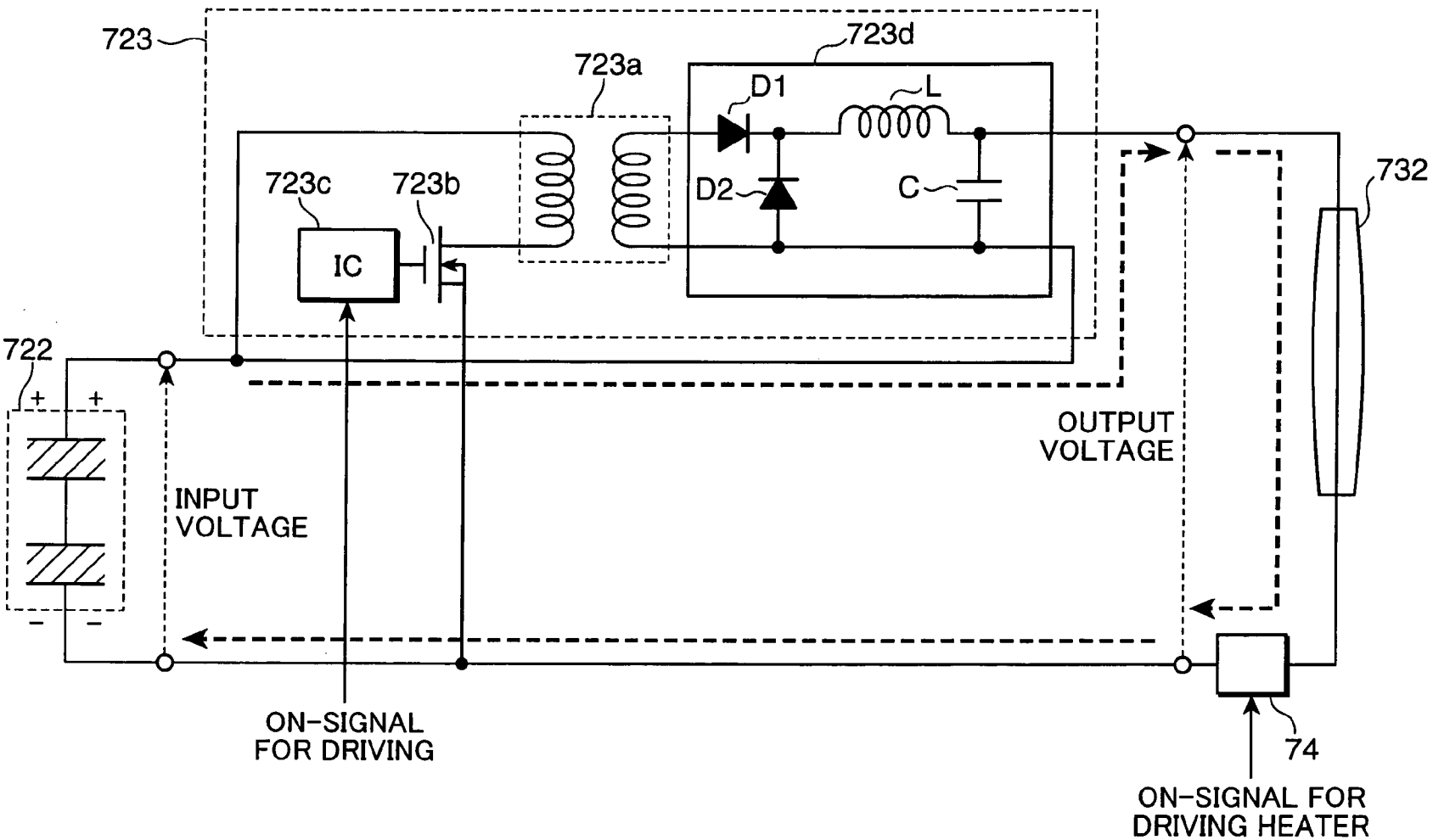
FIG. 6 is a circuit diagram showing a current path in a latter stage of the startup operation of the fixing device provided with the voltage boosting device in the first embodiment.

In the following, a control to be executed at a startup time of the fixing device 7 provided with the voltage boosting device 723 of the first embodiment is described. FIG. 4 is a flowchart showing the control to be executed at the startup time of the fixing device 7 provided with the voltage boosting device 723 in the first embodiment. FIG. 5 is a circuit diagram showing a current path in an initial stage of a startup operation of the fixing device 7. FIG. 6 is a circuit diagram showing a current path in a latter stage of the startup operation of the fixing device 7. FIGS. 7A through 7D are timing charts of a heater drive signal, a converter drive signal, an output current, and an output voltage at the startup time of the fixing device 7, respectively.

First, when the main power source switch of the complex machine 1 is turned on by a user's manipulation (YES in Step S1), the controller 10 turns on the first power source switch 71 to supply an electric power from the commercial power source 8 to the first fixing heater 731 so as to drive the first fixing heater 731 (Step S2).

Then, the controller 10 turns off the charging switch 75 (Step S3). Then, the controller 10 sends an off signal to the PWM controller 723*c* to suspend driving of the voltage boosting device 723, and switches over the MOS transistor 723*b* to suspend an electric power supply from the electric storage device 722 to the voltage boosting device 723 (Step S4). In other words, the controller 10 suspends driving of the voltage boosting device 723, and suspends a voltage boosting operation thereof. Then, the controller 10 turns on the auxiliary power source switch 74 to supply an electric power from the auxiliary power source unit 72 to the second fixing heater 732 (Step S5).

Figures 7A, 7B, 7C, 7D:
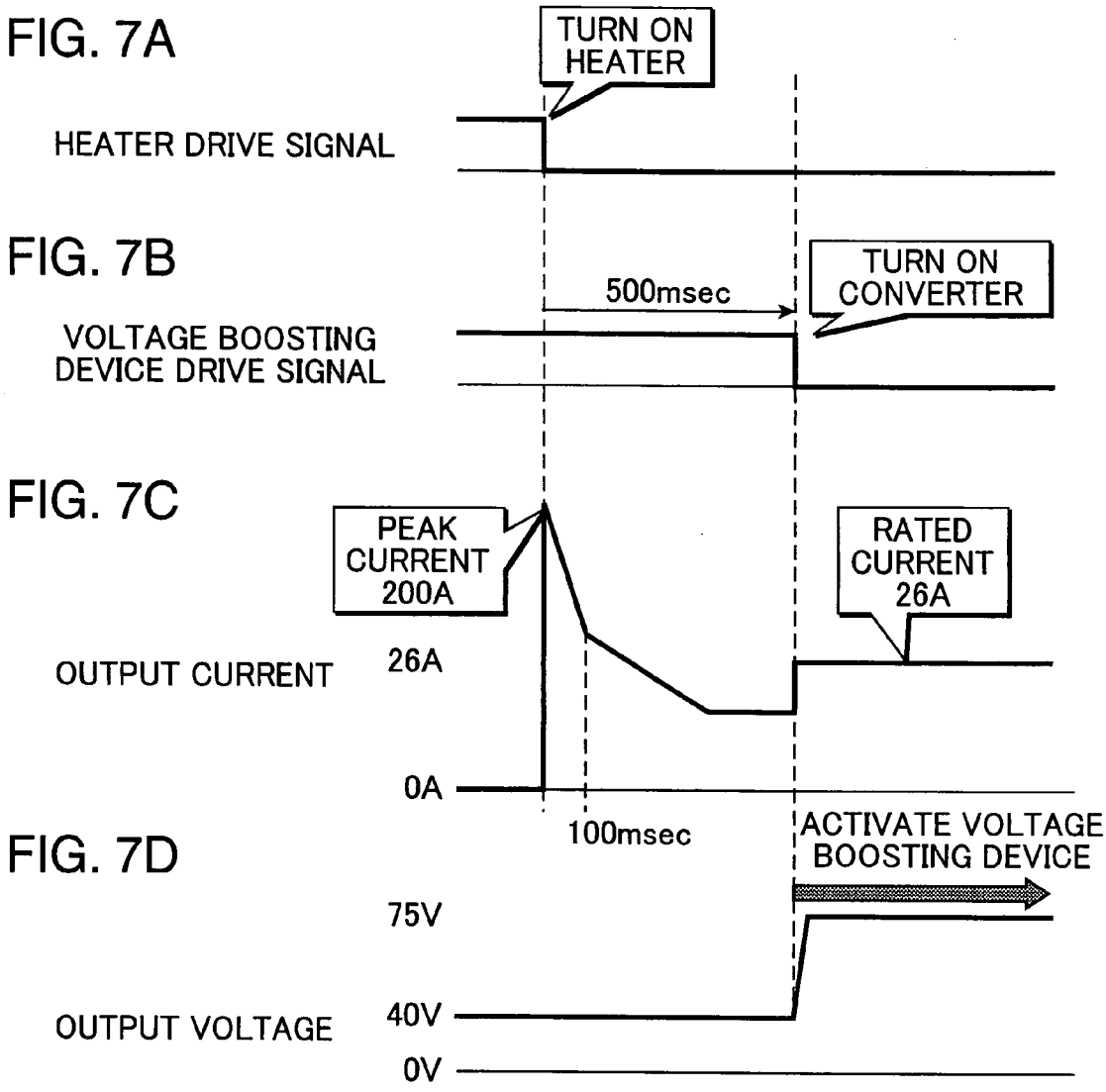
FIG. 7A is a timing chart of a heater drive signal at the startup time of the fixing device provided with the voltage boosting device in the first embodiment.
FIG. 7B is a timing chart of a converter drive signal at the startup time of the fixing device provided with the voltage boosting device in the first embodiment.
FIG. 7C is a timing chart of an output current at the startup time of the fixing device provided with the voltage boosting device in the first embodiment.
FIG. 7D is a timing chart of an output voltage at the startup time of the fixing device provided with the voltage boosting device in the first embodiment.

Specifically, as shown in FIGS. 7A through 7D, in response to turning on of the main power source switch of the complex machine 1, the controller 10 causes the fixing heater 731 to perform a driving operation (see FIG. 7A), and controls the voltage boosting device 723 to suspend a driving operation thereof (see FIG. 7B). Thereby, the output from the electric storage device 722 without boosting a voltage by the voltage boosting device 723 is supplied to the second fixing heater 732 (see FIG. 7C). In this arrangement, when the second fixing heater 732 is driven by the electric power supplied from the electric storage device 722, an inrush current flows to the second fixing heater 732 and the voltage boosting device 723 resulting from voltage application to the second fixing heater 732 in a low-temperature condition in the initial stage of driving the fixing heater unit (see FIG. 7C). However, the current path in the above condition is as illustrated in FIG. 5. Specifically, the inrush current flows to the second fixing heater 732 along a current path passing the diode D2 and the coil L provided in the smoothing circuit 723*d* of the voltage boosting device 723. In this case, a large current resulting from an inrush current over a rated current flows to the coil L. As a result, the coil L in the voltage boosting device 723 is saturated, and does not function as an inductor.

Thereafter, the timer 11 measures whether the predetermined duration corresponding to an estimated time required for the inrush current to drop to a certain low level e.g. an estimated time required for the rated current to flow to the second fixing heater 732 has elapsed (Step S6). If it is judged that the predetermined duration has elapsed (YES in Step S6), the controller 10 sends an on signal for driving the voltage boosting device 723 to the PWM controller 723*c*, and switches over the MOS transistor 723B to supply the electric power from the electric storage device 722 to the voltage boosting device 723 (Step S7). As described above, while the inrush current flows to the voltage boosting device 723, the coil L in the voltage boosting device 723 is saturated, and does not function as an inductor. However, once the inrush current drops to the certain low level, the coil L is recovered from the saturated state, and functions as the inductor. In view of this, in this embodiment, the controller 10 causes the voltage boosting device 723 to perform a voltage boosting operation after the inrush current has dropped to the certain low level, and the coil L is recovered from the saturated state. With this arrangement, after the inrush current has dropped to the certain low level, the superimposed voltage obtained by superimposing the voltage boosted by the voltage boosting device 723 over the output voltage from the electric storage device 722 is supplied to the second fixing heater 732.

Specifically, as shown in FIGS. 7A through 7D, the controller 10 drives the voltage boosting device 723 (see FIG. 7B) upon lapse of a certain duration after the inrush current has dropped to a certain low level (see FIG. 7C), and the coil L is recovered from a saturated state. Thereby, the current path is defined as shown in FIG. 6. Specifically, the superimposed voltage including the voltage boosted by the voltage boosting device 732 is outputted from the electric storage device 722 to the second fixing heater 732 (see FIG. 7D), and a rated current flows to the second fixing heater 732 and the voltage boosting device 723 (see FIG. 7C). In this condition, the coil L is recovered from the saturated state, and properly functions as the inductor. Accordingly, the voltage boosting operation is performed properly by the voltage boosting device 723.

For instance, in the case where a halogen heater driven at a rated capacity of 75 A/26 A is used as the second fixing heater 732, and an electric dual-layer capacitor with a full charged voltage of 40V is used as the electric storage device 722, a device having a performance of boosting an input voltage of 40V to 75V as an output voltage is used as the voltage boosting device 723. In this example, a resistance value of the second fixing heater 732 is as low as about one-tenth of a resistance value in a rated condition, when the second fixing heater 732 is in a low-temperature condition before being heated, because of a characteristic of the halogen heater. Accordingly, an inrush current i.e. a peak current as large as near 200 A may flow in an initial stage of voltage application, with the result that the inrush current may deprive the coil L of the function as the inductor. However, in this embodiment, the controller 10 controls the voltage boosting device 723 to suspend a voltage boosting operation in the initial stage of voltage application. Accordingly, despite the provision of the voltage boosting device 723, the electric power from the electric storage device 722 can be supplied to the second fixing heater 732 from an initial stage of driving the second fixing heater 732. This enables to reduce a startup time required for a fixing heating system. The controller 10 controls the voltage boosting device 723 to start a voltage boosting operation after the inrush current has disappeared, for instance, upon lapse of 100 msec after the first fixing heater 731 and the second fixing heater 732 are started to be driven. In FIG. 7C, the voltage boosting operation by the voltage boosting device 723 is started upon lapse of 500 msec after the first fixing heater 731 and the second fixing heater 732 are started to be driven. With this arrangement, a rated current e.g. 26 A which does not impair a voltage boosting operation is allowed to flow to the voltage boosting device 723, and a startup operation of the fixing heating system can be efficiently performed, aided by the superimposed voltage including the boosted voltage.

Figure 8:
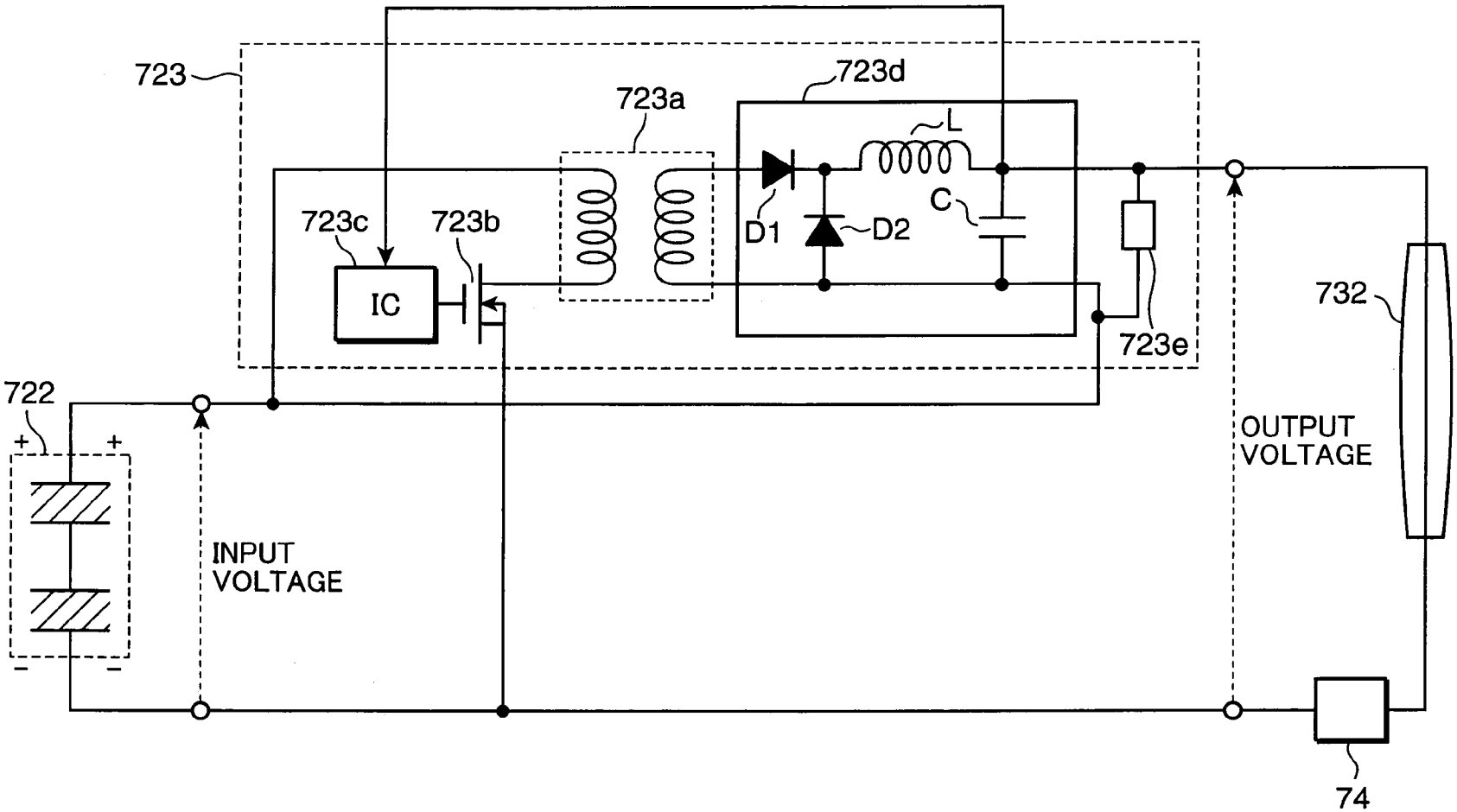
FIG. 8 is a circuit diagram showing a schematic arrangement of a voltage boosting device, as well as a connecting relation between the voltage boosting device, and an electric storage device and a second fixing heater in a second embodiment of the invention.

In the following, an arrangement of a voltage boosting device 723 according to a second embodiment of the invention is described. FIG. 8 is a circuit diagram showing a schematic arrangement of the voltage boosting device 723, as well as a connecting relation between an electric storage device 722 and a second fixing heater 732. The elements in the second embodiment which are identical or equivalent to those in the first embodiment are denoted at the same reference numerals, and description thereof will be omitted herein.

As shown in FIG. 8, the voltage boosting device 723 of the second embodiment is provided with a bypass switch 723*e* i.e. a bypass switching mechanism or a bypass changer of the claimed invention, in addition to a transformer 723*a*, an MOS transistor 723*b*, a PWM controller 723*c*, and a smoothing circuit 723*d*.

The bypass switch 723*e* is a switching mechanism for switching over whether an electric power from the electric storage device 722 is to be supplied to the second fixing heater 732 by bypassing the voltage boosting device 723. As shown in FIG. 8, the bypass switch 723*e* is connected to a secondary end of the voltage boosting device 723 by short-circuiting the voltage boosting device 723 at a position between the secondary end of the voltage boosting device 723 and a second fixing heater unit 732, and at a position between the secondary end of the voltage boosting device 723 and the electric storage device 722. With use of the bypass switch 723*e* having the above arrangement, the electric power from the electric storage device 722 is allowed to be supplied to the second fixing heater 732 by bypassing the voltage boosting device 723.

A controller 10 controls the bypass switch 723*e* to perform a switching operation between supplying an output from the electric storage device 722 to the second fixing heater 732 by bypassing the voltage boosting device 723 until lapse of a predetermined duration measured by a timer 11; and supplying, to the second fixing heater 732, a superimposed voltage obtained by superimposing a voltage boosted by the voltage boosting device 723 over the output voltage from the electric storage device 722, by blocking the bypass of the voltage boosting device 723 upon lapse of the predetermined duration measured by the timer 11.

Figure 9:
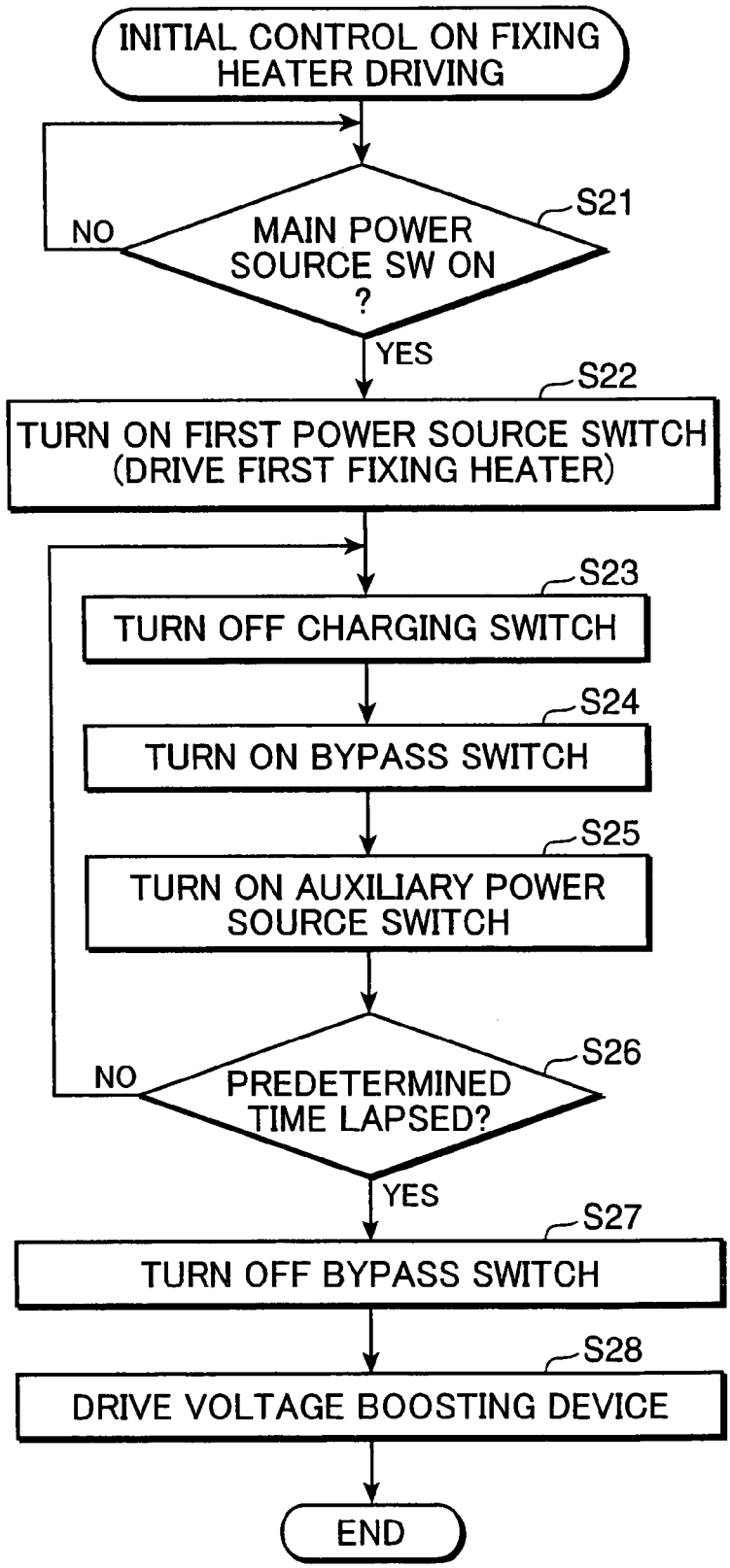
FIG. 9 is a flowchart showing a control to be executed at a startup time of a fixing device provided with the voltage boosting device in the second embodiment.
Figure 10:
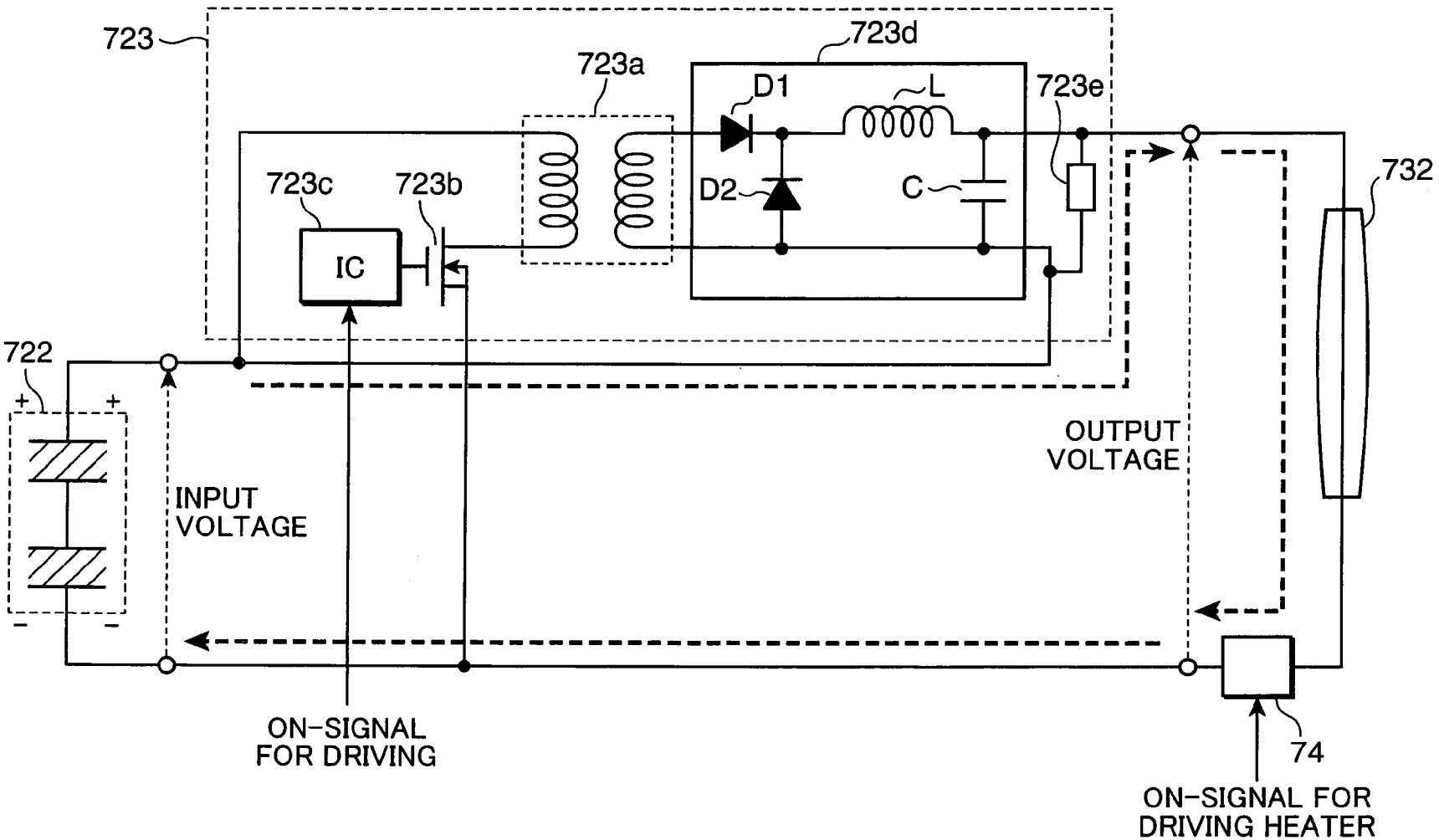
FIG. 10 is a circuit diagram showing a current path in an initial stage of a startup operation of the fixing device provided with the voltage boosting device in the second embodiment.
Figure 11:
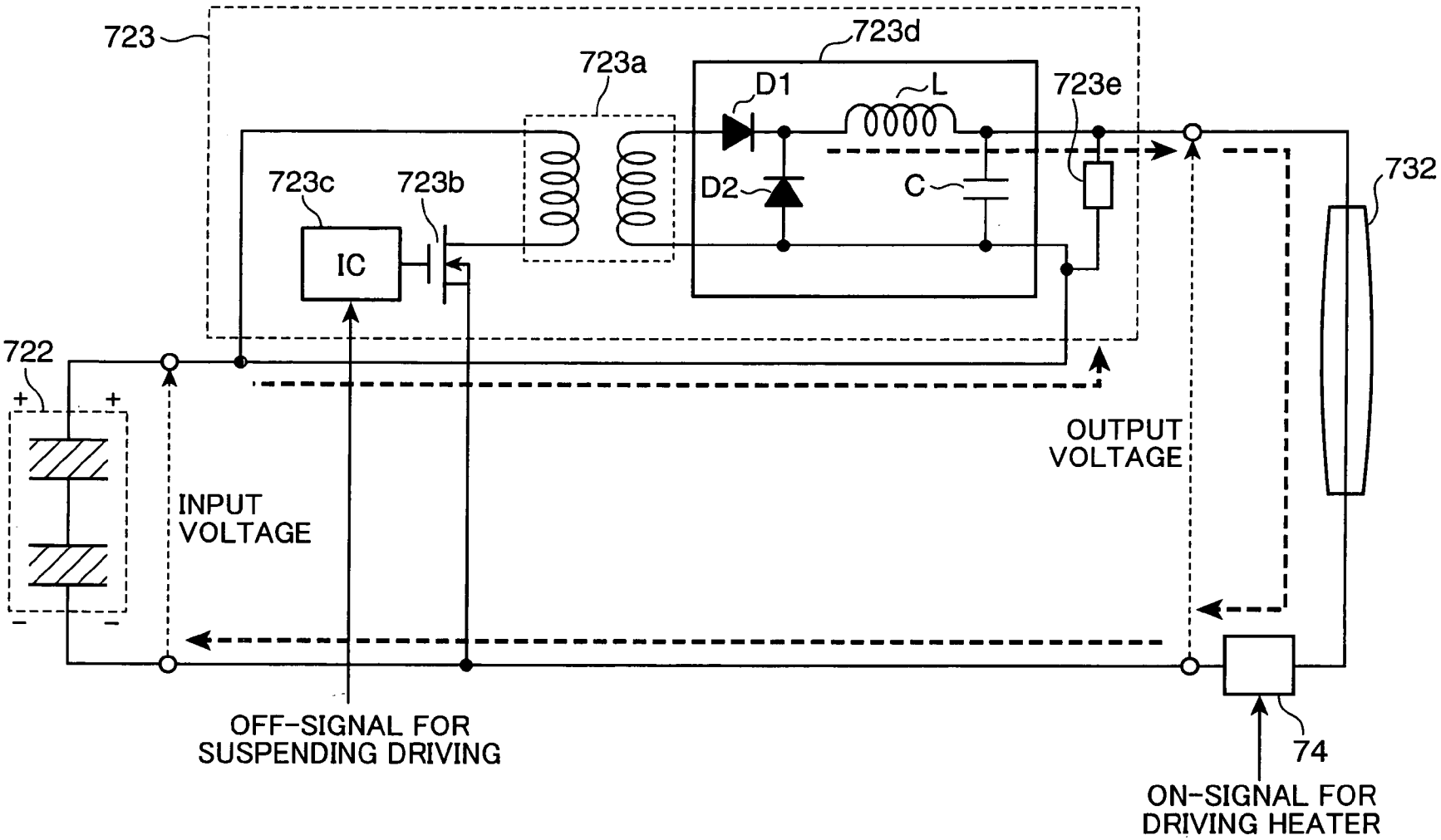
FIG. 11 is a circuit diagram showing a current path in a latter stage of the startup operation of the fixing device provided with the voltage boosting device in the second embodiment.

Next, a control to be executed at a startup time of a fixing device 7 provided with the voltage boosting device 723 of the second embodiment is described. FIG. 9 is a flowchart showing the control to be executed at the startup time of the fixing device 7 provided with the voltage boosting device 723 of the second embodiment. FIG. 10 is a circuit diagram showing a current path in an initial stage of a startup operation of the fixing device 7. FIG. 11 is a circuit diagram showing a current path in a latter stage of the startup operation of the fixing device 7. FIGS. 12A through 12D are timing charts of a heater drive signal, a bypass switch signal, an output current, and an output voltage at the startup time of the fixing device 7, respectively.

Referring to FIG. 9, when a main power source switch of a complex machine 1 is turned on by a user's manipulation (YES in Step S21), the controller 10 turns on a first power source switch 71 to supply an electric power from a commercial power source 8 to a first fixing heater 731 so as to drive the first fixing heater 731 (Step S22). Then, the controller 10 turns off a charging switch 75 (Step S23). Then, the controller 10 turns on the bypass switch 723*e* to supply an electric power from the electric storage device 722 to the voltage boosting device 723 by bypassing the voltage boosting device 723 (Step S24). Subsequently, the controller 10 turns on an auxiliary power source switch 74 to supply an electric power from an auxiliary power source unit 72 to the second fixing heater 732 (Step S25).

Figures 12A, 12B, 12C, 12D:
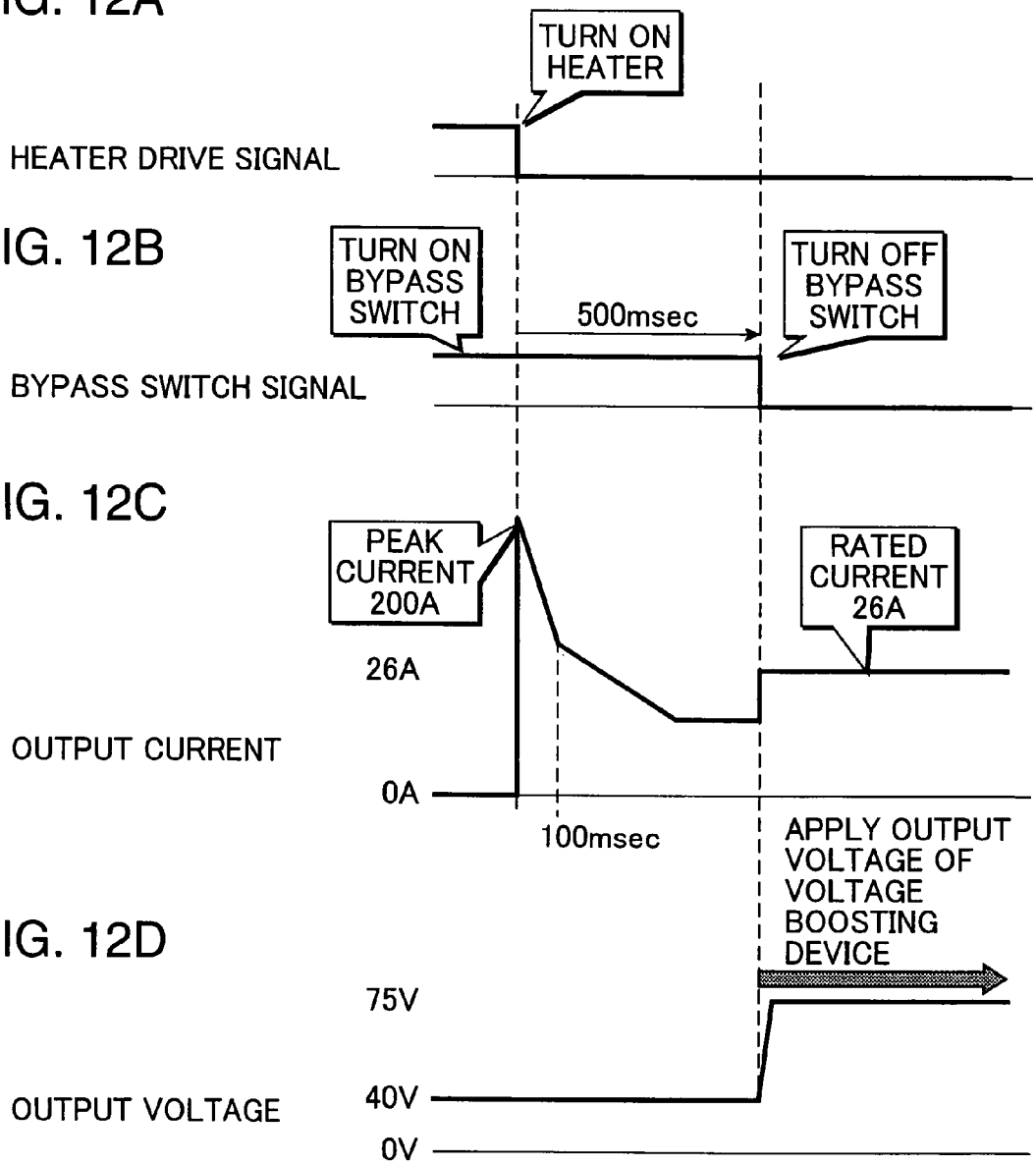
FIG. 12A is a timing chart of a heater drive signal at the startup time of the fixing device provided with the voltage boosting device in the second embodiment.
FIG. 12B is a timing chart of a converter drive signal at the startup time of the fixing device provided with the voltage boosting device in the second embodiment.
FIG. 12C is a timing chart of an output current at the startup time of the fixing device provided with the voltage boosting device in the second embodiment.
FIG. 12D is a timing chart of an output voltage at the startup time of the fixing device provided with the voltage boosting device in the second embodiment.

Specifically, as shown in FIGS. 12A through 12D, when the main power source switch of the complex machine 1 is turned on, the controller 10 drives the first fixing heater 731 (see FIG. 12A). The controller 10 also turns on the bypass switch 723*e* (see FIG. 12B) so that the output from the electric storage device 722 is supplied to the second fixing heater 732 without boosting a voltage by the voltage boosting device 723 (see FIG. 12D). When the second fixing heater 732 is driven by the electric power supplied from the electric storage device 722, an inrush current flows to the second fixing heater 732 (see FIG. 12C) by voltage application to the second fixing heater 732 in a low-temperature condition in an initial stage of driving the second fixing heater 732. However, as shown in FIG. 10, the current path in this condition is defined in such a manner that a current flows to the second fixing heater 732 en route the bypass switch 723*e* because the voltage boosting device 723 is bypassed. With this arrangement, an inrush current i.e. a large current over a rated current does not flow to a coil L in the voltage boosting device 723, and accordingly, the coil L is not brought to a saturated state. Thus, an unduly large load is not exerted to the coil L.

Thereafter, the timer 11 measures whether a predetermined duration corresponding to an estimated time required for the inrush current to drop to a certain low level e.g. an estimated time required for the rated current to flow to the second fixing heater 732 has elapsed (Step S26). If it is judged that the predetermined duration has elapsed (YES in Step S26), the controller 10 turns off the bypass switch 723*e* so that the electric power from the electric storage device 722 is boosted by the voltage boosting device 723 (Step S27).

Then, the controller 10 sends an on signal for driving the voltage boosting device 723 to a PWM controller 723*c*, and switches over an MOS transistor 723*b* to supply the electric power from the electric storage device 722 to the voltage boosting device 723 (Step S28). In other words, the controller 10 causes the voltage boosting device 723 to perform a voltage boosting operation. Thereby, after the inrush current has dropped to the certain low level, the superimposed voltage obtained by superimposing the voltage boosted by the voltage boosting device 723 over the output voltage from the electric storage device 722 is supplied to the second fixing heater 732.

Specifically, as shown in FIGS. 12A through 12D, upon lapse of a certain duration after the inrush current has dropped to a certain low level (see FIG. 12C), the controller 10 turns off the bypass switch 723*e* (see FIG. 12B). Thereby, as shown in FIG. 11, a current path is defined, in which the superimposed voltage including the voltage boosted by the voltage boosting device 723 is supplied from the electric storage device 722 to the second fixing heater 732 (see FIG. 12D). In this condition, the voltage boosting device 723 is not subjected to an influence of the inrush current. Accordingly, a rated current flows to the second fixing heater 732 and the voltage boosting device 723 (see FIG. 12C). Therefore, the coil L properly functions as an inductor without being subjected to an adverse effect of the inrush current, and a voltage boosting operation is properly performed by the voltage boosting device 723.

For instance, in the case where a halogen heater driven at a rated capacity of 75 A/26 A is used as the second fixing heater 732, and an electric dual-layer capacitor with a full charged voltage of 40V is used as the electric storage device 722, a device having a performance of boosting an input voltage of 40V to 75V as an output voltage is used as the voltage boosting device 723. In this example, a resistance value of the second fixing heater 732 is as low as about one-tenth of a resistance value in a rated condition, when the second fixing heater 732 is in a low-temperature condition before being heated, because of a characteristic of the halogen heater. Accordingly, an inrush current i.e. a peak current as large as near 200 A flows in an initial stage of voltage application. However, the aforementioned bypass control in the second embodiment prevents an inrush current from flowing to the voltage boosting device 723, thereby eliminating an adverse effect of the inrush current to the voltage boosting device 723. Accordingly, despite the provision of the voltage boosting device 723, the electric power from the electric storage device 722 can be supplied to the second fixing heater 732 from an initial stage of driving the second fixing heater 732. This enables to reduce a startup time required for a fixing heating system. The controller 10 controls the voltage boosting device 723 to start a voltage boosting operation after the inrush current has disappeared, for instance, upon lapse of 100 msec after the first fixing heater 731 and the second fixing heater 732 are started to be driven. In FIG. 12C, the voltage boosting operation by the voltage boosting device 723 is started upon lapse of 500 msec after the first fixing heater 731 and the second fixing heater 732 are started to be driven. With this arrangement, a rated current e.g. 26 A which does not impair a voltage boosting operation is allowed to flow to the voltage boosting device 723, and a startup operation of the fixing heating system can be efficiently performed, aided by the superimposed voltage including the boosted voltage.

In the process shown in FIG. 9, after the controller 10 turns off the bypass switch 723*e* (Step S27), the voltage boosting device 723 is driven (Step S28). The voltage boosting device 723 may be driven at any timing after the bypass switch 723*e* is turned on in Step S24.

The invention is not limited to the foregoing embodiments, but the following modifications may be applied to the invention.

Figure 13:
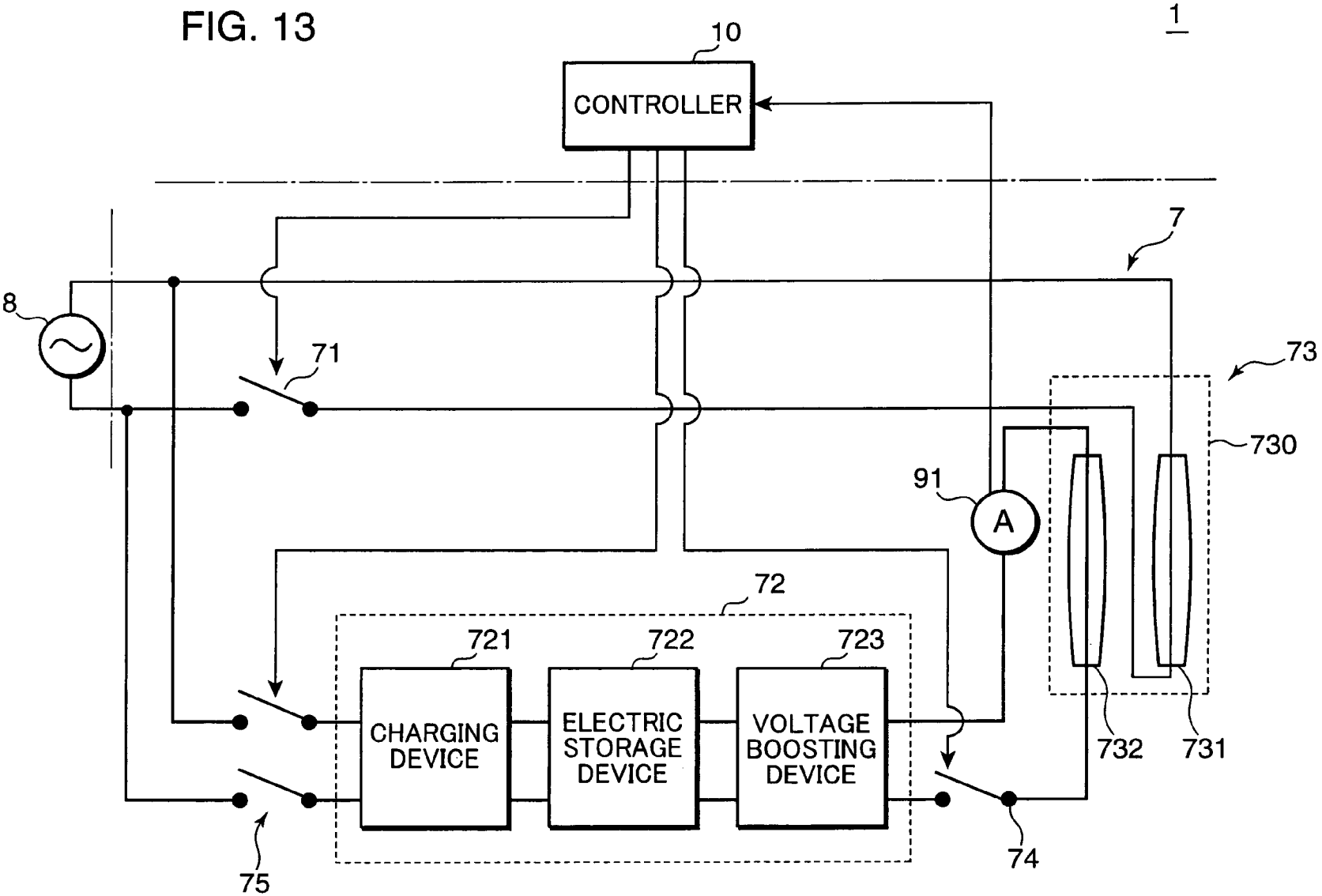
FIG. 13 is a diagram schematically showing a modification of the invention.

(A) In the embodiments, after the timer 11 measures the lapse of the predetermined duration, the controller 10 is operative to a) start a voltage boosting operation by the voltage boosting device 723, or b) start a voltage boosting operation by the voltage boosting device 723 by changing over the bypass switch 723*e*. Alternatively, as shown in FIG. 13, in place of using the timer 11, a current meter 91 as a current detector may be connected between the auxiliary power source unit 72 and the second fixing heater 732. Then, the controller 10 performs the following operation c) or d) based on a premise that detection of a certain current value showing that the inrush current has dropped to a certain low level e.g. a current value lower than a rated current value by the current meter 91 indicates that the coil L is recovered from a saturated state. Specifically, c) the controller 10 sends an on signal for driving the voltage boosting device 723 to the PWM controller 723*c*, and switches over the MOS transistor 723*b* to supply the electric power from the electric storage device 722 to the voltage boosting device 723. In other words, the operation described referring to FIG. 13 is performed in place of Step S6 in FIG. 4; or d) the controller 10 switches over the bypass switch 723*e* to start a voltage boosting operation by the voltage boosting device 723. In other words, the operation described referring to FIG. 13 is performed in place of Step S26 in FIG. 9.

In the modification, the controller 10 causes the voltage boosting device 723 to drive based on the current value detected by the current meter 91. This enables to determine the period when the inrush current flows to the voltage boosting device 723 with high precision, which allows the voltage boosting device 723 to drive while securely avoiding the inrush current.

Figure 14:
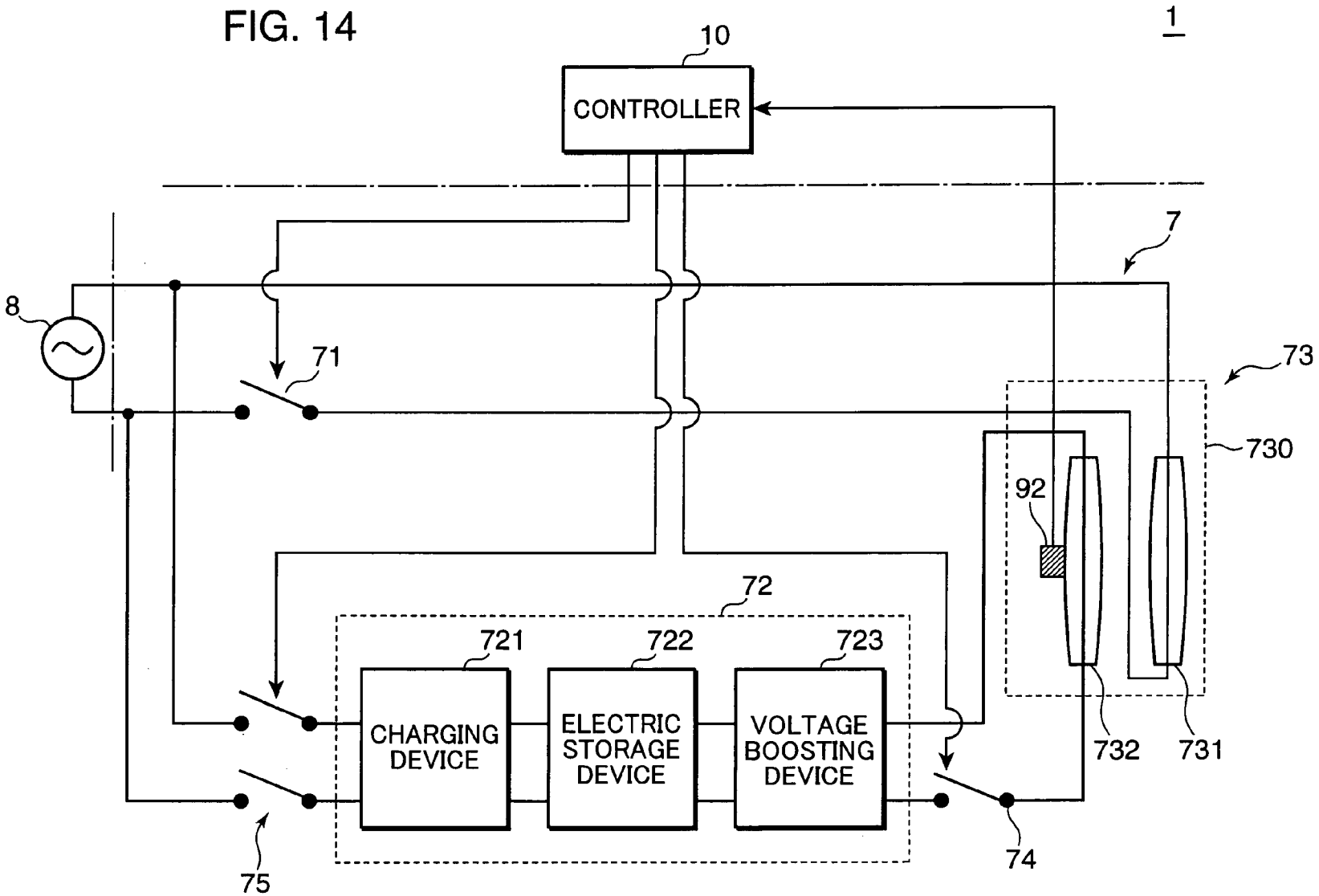
FIG. 14 is a diagram schematically showing another modification of the invention.

(B) Further alternatively, as shown in FIG. 14, in place of using the timer 11, a temperature sensor 92 as a temperature detector e.g. a thermometer may be provided near the second fixing heater 723 to detect a temperature of the second fixing heater 732. Then, the controller 10 performs the following operation e) or f) based on a premise that detection of a certain temperature showing that the inrush current has dropped to a certain low level by the temperature sensor 92 indicates that the coil L is recovered from a saturated state.

Specifically, e) the controller 10 sends an on signal for driving the voltage boosting device 723 to the PWM controller 723*c*, and switches over the MOS transistor 723*b* to supply the electric power from the electric storage device 722 to the voltage boosting device 723. In other words, the operation described referring to FIG. 13 is performed in place of Step S6 in FIG. 4; or f) the controller 10 switches over the bypass switch 723*e* to start a voltage boosting operation by the voltage boosting device 723. In other words, the operation described referring to FIG. 13 is performed in place of Step S26 in FIG. 9.

In the modification, the controller 10 causes the voltage boosting device 723 to drive based on the temperature detected by the temperature sensor 92. This enables to determine the period when the inrush current flows to the voltage boosting device 723 with a simplified operation.

(C) In the embodiments, the transformer 723*a* is used in the voltage boosting device 723. Alternatively, an insulating DC/DC converter provided with an insulator other than the transformer may be incorporated in the voltage boosting device 723.

The image forming apparatus of the invention is not limited to the complex machine 1. An image forming apparatus other than the complex machine 1 may be applied to the invention. Also, the arrangements and the processes described referring to FIGS. 1 through 13 are merely an embodiment of the invention. Arrangements and processes of the invention are not limited to those described above in the foregoing embodiments and/or modifications.

To summarize the invention, an image forming apparatus includes: a capacitor serving as an auxiliary power source device; a fixing heater unit including a first fixing heater driven by an electric power from an external power source, and a second fixing heater provided with a halogen heater and driven by an electric power from the auxiliary power source device, the fixing heater unit being adapted to apply a heat to a fixing device for fixing a toner on a sheet; an insulating converter serving as a voltage boosting circuit configured in such a manner that a primary end of the insulating converter is connected to the auxiliary power source device, an end of a secondary end thereof is connected to the second fixing heater, and the other end of the secondary end is connected to the auxiliary power source device, the voltage boosting circuit being adapted to boost an output voltage from the auxiliary power source device to output the boosted voltage to the second fixing heater; and a controller for controlling the electric power supply to the fixing heater unit, wherein the second fixing heater has an end thereof connected to the secondary end of the voltage boosting circuit, and the other end thereof connected to the auxiliary power source device, and the controller is operative to drive the first fixing heater by the electric power from the external power source, and drive the second fixing heater by the electric power from the auxiliary power source device without superimposing an output from the voltage boosting circuit in an initial stage of driving the fixing heater unit; and drive the second fixing heater by a superimposed output upon lapse of a predetermined duration while an inrush current flows to the second fixing heater, the superimposed output being obtained by superimposing the output from the voltage boosting circuit over an output from the auxiliary power source device.

In the above arrangement, the controller is operative to drive the first fixing heater by the output from the external power source, and drive the second fixing heater by the output from the auxiliary power source device without superimposing the output from the voltage boosting circuit in the initial stage of driving the fixing heater unit. Thereby, the electric power from the auxiliary power source device can be supplied to the second fixing heater without causing an adverse effect resulting from the inrush current in the voltage boosting circuit even in an inrush current flow period. This enables to reduce a time required for a fixing roller to reach a predetermined fixing temperature.

Preferably, the image forming apparatus may further include: a drive changer for changing over the voltage boosting circuit to drive the voltage boosting circuit or suspend the driving of the voltage boosting circuit, wherein the controller is operative to drive the first fixing heater by the electric power from the external power source, and drive the second fixing heater by the electric power from the auxiliary power source device in a state that the driving of the voltage boosting circuit is suspended by the drive changer in the initial stage of driving the fixing heater unit; and controls the drive changer to drive the voltage boosting circuit upon lapse of the predetermined duration while the inrush current flows to the second fixing heater to supply the superimposed output to the second fixing heater.

In the above arrangement, the electric power from the auxiliary power source device can be supplied to the second fixing heater even in the period when the inrush current flows to the voltage boosting circuit in supplying the electric power from the auxiliary power source device to the second fixing heater. This enables to reduce the time required for the fixing roller to reach the predetermined fixing temperature.

Preferably, the image forming apparatus may further include: a bypass changer for changing over whether the output from the auxiliary power source device is to be supplied to the second fixing heater by bypassing the voltage boosting circuit in supplying the electric power from the auxiliary power source device to the second fixing heater, wherein the controller is operative to drive the first fixing heater by an output from the external power source, and drive the second fixing heater by the output from the auxiliary power source device by bypassing the voltage boosting circuit by the bypass changer in the initial stage of driving the fixing heater unit; and supply the superimposed output to the second fixing heater by blocking the bypass of the voltage boosting circuit by the bypass changer upon lapse of the predetermined duration after the inrush current flows to the second fixing heater.

Preferably, the bypass changer may be connected to the secondary end of the voltage boosting circuit in a state that the voltage boosting circuit is short-circuited at a position between the secondary end of the voltage boosting circuit and the fixing heater unit, and at a position between the secondary end of the voltage boosting circuit and the auxiliary power source device to supply the output from the auxiliary power source device to the second fixing heater by bypassing the voltage boosting circuit.

In the above arrangements, the electric power from the auxiliary power source device can be supplied to the second fixing heater without causing an adverse effect of the inrush current to the voltage boosting circuit even in the inrush current flow period. This enables to reduce the time required for the fixing roller to reach the predetermined fixing temperature.

Preferably, the insulating converter may be an insulating transformer.

Preferably, the image forming apparatus may further include a timer for measuring a time, wherein if the timer measures the lapse of the predetermined duration indicating that the inrush current has dropped to a certain low level, the controller controls the drive changer to drive the voltage boosting circuit so as to supply the superimposed output to the second fixing heater.

In the above arrangement, the point of time when the inrush current has dropped to the certain low level can be determined by measuring the lapse of the predetermined duration by the timer. This enables to determine the period when the inrush current flows to the voltage boosting circuit with a simplified operation.

Preferably, the image forming apparatus may further include a current detector for detecting a value of a current flowing to the second fixing heater, wherein if the current detector detects the current value indicating that the inrush current has dropped to a certain low level, the controller controls the drive changer to drive the voltage boosting circuit so as to supply the superimposed output to the second fixing heater.

In the above arrangement, the point of time when the inrush current has dropped to the certain low level can be determined by detecting the current value indicating that the inrush current has dropped to the certain low level by the current detector. This enables to determine the period when the inrush current flows to the voltage boosting circuit with high precision.

Preferably, the image forming apparatus may further include a temperature detector for detecting a temperature of the second fixing heater, wherein if the temperature detector detects the temperature indicating that the inrush current has dropped to a certain low level, the controller controls the drive changer to drive the voltage boosting circuit so as to supply the superimposed output to the second fixing heater.

In the above arrangement, the point of time when the inrush current has dropped to the certain low level can be determined by detecting the temperature indicating that the inrush current has dropped to the certain low level by the temperature detector. This enables to determine the period when the inrush current flows to the voltage boosting circuit with a simplified operation.

This application is based on Japanese Patent Application No. 2006-213812 and No. 2006-218684 filed on Aug. 4, 2006, and Aug. 10, 2006, respectively, the contents of which are hereby incorporated by reference.

Although the invention has been appropriately and fully described by way of examples with reference to the accompanying drawings, it is to be understood that various changes and/or modifications will be apparent to those skilled in the art. Therefore, unless otherwise such changes and/or modifications depart from the scope of the present invention hereinafter defined, they should be construed as being included therein.

What is claimed is:

1. An image forming apparatus, comprising:

a capacitor serving as an auxiliary power source device;

a fixing heater unit including a first fixing heater driven by an electric power from an external power source, and a second fixing heater provided with a halogen heater and driven by an electric power from the auxiliary power source device, the fixing heater unit being adapted to apply a heat to a fixing device for fixing a toner on a sheet;

an insulating converter serving as a voltage boosting circuit configured in such a manner that a primary end of the insulating converter is connected to the auxiliary power source device, an end of a secondary end thereof is connected to the second fixing heater, and the other secondary end of the secondary end is connected to the auxiliary power source device, the voltage boosting circuit being adapted to boost an output voltage from the auxiliary power source device to output the boosted voltage to the second fixing heater; and a controller for controlling the electric power supply to the fixing heater unit, wherein the second fixing heater has an end thereof connected to the secondary end of the voltage boosting circuit, and the other end thereof connected to the auxiliary power source device, and the controller is operative to drive the first fixing heater by the electric power from the external power source, and drive the second fixing heater by the electric power from the auxiliary power source device without superimposing an output from the voltage boosting circuit in an initial stage of driving the fixing heater unit; and drive the second fixing heater by a superimposed output upon lapse of a predetermined duration while an inrush current flows to the second fixing heater, the superimposed output being obtained by superimposing the output from the voltage boosting circuit over an output from the auxiliary power source device.

2. The image forming apparatus according to claim 1, further comprising:

a drive changer for changing over the voltage boosting circuit to drive the voltage boosting circuit or suspend the driving of the voltage boosting circuit, wherein the controller is operative to drive the first fixing heater by the electric power from the external power source, and drive the second fixing heater by the electric power from the auxiliary power source device in a state that the driving of the voltage boosting circuit is suspended by the drive changer in the initial stage of driving the fixing heater unit; and controls the drive changer to drive the voltage boosting circuit upon lapse of the predetermined duration while the inrush current flows to the second fixing heater to supply the superimposed output to the second fixing heater.

3. The image forming apparatus according to claim 2, wherein the insulating converter is an insulating transformer.

4. The image forming apparatus according to claim 2, further comprising a timer for measuring a time, wherein if the timer measures the lapse of the predetermined duration indicating that the inrush current has dropped to a certain low level, the controller controls the drive changer to drive the voltage boosting circuit so as to supply the superimposed output to the second fixing heater.

5. The image forming apparatus according to claim 2, further comprising a current detector for detecting a value of a current flowing to the second fixing heater, wherein if the current detector detects the current value indicating that the inrush current has dropped to a certain low level, the controller controls the drive changer to drive the voltage boosting circuit so as to supply the superimposed output to the second fixing heater.

6. The image forming apparatus according to claim 2, further comprising a temperature detector for detecting a temperature of the second fixing heater, wherein if the temperature detector detects the temperature indicating that the inrush current has dropped to a certain low level, the controller controls the drive changer to drive the voltage boosting circuit so as to supply the superimposed output to the second fixing heater.

7. The image forming apparatus according to claim 1, further comprising: a bypass changer for changing over whether the output from the auxiliary power source device is to be supplied to the second fixing heater by bypassing the voltage boosting circuit in supplying the electric power from the auxiliary power source device to the second fixing heater, wherein the controller is operative to drive the first fixing heater by an output from the external power source, and drive the second fixing heater by the output from the auxiliary power source device by bypassing the voltage boosting circuit by the bypass changer in the initial stage of driving the fixing heater unit; and supply the superimposed output to the second fixing heater by blocking the bypass of the voltage boosting circuit by the bypass changer upon lapse of the predetermined duration after the inrush current flows to the second fixing heater.

8. The image forming apparatus according to claim 7, wherein the bypass changer is connected to the secondary end of the voltage boosting circuit in a state that the voltage boosting circuit is short-circuited at a position between the secondary end of the voltage boosting circuit and the fixing heater unit, and at a position between the secondary end of the voltage boosting circuit and the auxiliary power source device to supply the output from the auxiliary power source device to the second fixing heater by bypassing the voltage boosting circuit.

9. The image forming apparatus according to claim 7, wherein the insulating converter is an insulating transformer.

10. The image forming apparatus according to claim 7, further comprising a timer for measuring a time, wherein if the timer measures the lapse of the predetermined duration indicating that the inrush current has dropped to a certain low level, the controller controls the bypass changer to supply the superimposed output to the second fixing heater.

11. The image forming apparatus according to claim 7, further comprising a current detector for detecting a value of a current flowing through the second fixing heater, wherein if the current detector detects the current value indicating that the inrush current has dropped to a certain low level, the controller controls the bypass changer to supply the superimposed output to the second fixing heater.

12. The image forming apparatus according to claim 7, further comprising a temperature detector for detecting a temperature of the second fixing heater, wherein if the temperature detector detects the temperature indicating that the inrush current has dropped to a certain low level, the controller controls the bypass changer to supply the superimposed output to the second fixing heater.

* * * * *